US005176007A

United States Patent [19]

Komatsu et al.

[11] Patent Number: 5,176,007

[45] Date of Patent: Jan. 5, 1993

[54] REFRIGERATOR WITH LUBRICANT MIXTURE SENSOR

[75] Inventors: Syunji Komatsu, Isesaki; Yuji Nakajima, Kodama; Masaru Kuribara, Tatebayashi; Kazumitsu Kobayashi, Isesaki, all of Japan

[73] Assignees: Sanden Corporation; Japan Electronic Control Systems Company, Inc., both of Gunma, Japan

[21] Appl. No.: 814,440

[22] Filed: Dec. 30, 1991

[30] Foreign Application Priority Data

Dec. 28, 1990 [JP] Japan ..... 2-405879[U]

[51] Int. Cl.[5] ..... F25B 31/02

[52] U.S. Cl. ..... 62/193; 62/126; 62/228.1

[58] Field of Search ..... 62/228.1, 126, 193

[56] References Cited

U.S. PATENT DOCUMENTS

| | | | |
|---|---|---|---|
| 3,477,240 | 11/1969 | Thoren et al. | 62/197 |
| 4,344,293 | 8/1982 | Fujiwara et al. | 62/126 |
| 4,526,012 | 7/1985 | Chigira | 62/196.3 |
| 4,633,675 | 1/1987 | Sato | 62/208 |
| 4,966,013 | 10/1990 | Wood | 62/126 |
| 5,054,294 | 10/1991 | Dudley | 62/126 |

FOREIGN PATENT DOCUMENTS

| | | | |
|---|---|---|---|
| 225952 | 9/1990 | Japan | 62/193 |

*Primary Examiner*—John Rivell
*Assistant Examiner*—L. R. Leo
*Attorney, Agent, or Firm*—Baker & Botts

[57] ABSTRACT

A refrigerator having a refrigerant circulating circuit for circulating a mixture of a refrigerant and a refrigerating machine oil. The refrigerator includes a compressor with a bypass circuit or a variable displacement compressor, a state detecting sensor for sensing the degree of separation of the refrigerant mixture, determining circuit for determining whether the detected degree of separation is in a two phase separation area, and a control unit for controlling the amount of the refrigerant passing through the bypass circuit or the displacement of the variable displacement compressor. When the refrigerant mixture enters into the two phase separation area, the amount of discharge or the displacement of the compressor is decreased. The temperature of refrigerant mixture is lowered accordingly and the phase changes from the two phase separation area. The refrigerating machine oil is maintained in a uniformly mixed state with the refrigerant and circulates with the refrigerant to the compressor. As a result, a lock up or breakage of the compressor is prevented.

18 Claims, 3 Drawing Sheets

REFRIGERATOR WITH LUBRICANT MIXTURE SENSOR

BACKGROUND OF THE INVENTION

1. Field of the Invention

The present invention relates to a refrigerator having a refrigerant circulating circuit in which a mixture of a refrigerant and a refrigerating machine oil is circulated.

2. Description of the Prior Art

A typical conventional refrigerator air for vehicles is shown in FIG. 6. A refrigerant such as freon gas is circulated in refrigerant circulating circuit 1 formed from pipe 2. Compressor 3, condenser 4, receiver dryer 5, expansion valve 6 and evaporator 7 are provided in circulating circuit 1 sequentially in the direction of circulation of the refrigerant, shown by arrows. The endothermic surface of evaporator 7 is exposed to the interior of the vehicle (not shown). After the refrigerant is compressed by compressor 3, the refrigerant is transformed in phase from a high-pressure gas to a high-pressure liquid in condenser 4 and further to a low-pressure gas as it passes through expansion valve 6 and evaporator 7. When the refrigerant is transformed from a liquid phase to a gaseous phase (vapor phase) by evaporator 7, the refrigerant absorbs heat from the interior of the vehicle and the vehicle interior is cooled. In such a refrigerator, a mixture of a refrigerant and a refrigerating machine oil is usually used as the refrigerant circulated in the circulating circuit 1. The refrigerating machine oil lubricates the slidable portions of compressor 3.

Although freon has been mainly used as the refrigerant for such a refrigerator, recently substitute refrigerants for freon have been used. Among refrigerating machine oils used for such substitute refrigerants, there are some oils which cannot sufficiently dissolve in the refrigerants. In such a case, the compatibility between the refrigerant and the refrigerating machine oil depends on temperature. Namely, if the temperature of a mixture of a refrigerant and a refrigerating machine oil is high, the refrigerant and the refrigerating machine oil are separated to a two phase mixture. As the result of such a two phase separation, a part of the refrigerating machine oil stagnates in some portions in circulating circuit 1, and an insufficient amount of the refrigerating machine oil is returned to compressor 3. Consequently, there is a possibility that compressor 3 may lock up or break.

SUMMARY OF THE INVENTION

Accordingly, an object of the present invention is to provide a refrigerator which can prevent a two phase separation in a mixture of a refrigerant and a refrigerating machine oil circulated in a refrigerant circulating circuit, thereby preventing a compressor from locking up or breaking.

To achieve this object, the present invention provides a refrigerator having a refrigerant circulating circuit for circulating a mixture of a refrigerant and a refrigerating machine oil. The refrigerator comprises a compressor device for compressing the mixture at variable displacement, a condenser coupled to an output of the compressor device, an expansion valve coupled to an output of the condenser, an evaporator coupled to an output of the condenser and to an input of the compressor device, a state detecting device coupled between the condenser and the expansion valve, a determining device coupled to the state detecting device and a control device coupled between the determining device and the compressor device. The state detecting device detects a degree of separation of the mixture in the circulating circuit and outputs a detection signal related to the detected degree of separation. The determining device determines whether the detection signal is greater or less than a reference value and outputs a determination signal related to the determination. The control device controls the displacement of the compressor device in accordance with the determination of the determining device.

In the refrigerator, a phase state of a mixture of a refrigerant and a refrigerating machine oil is detected by the state detecting device. The detection signal related to the detected degree of separation is sent from the state detecting device to the determining device. The determining device compares the detection signal with a predetermined reference value, and determines whether the detection signal is greater or less than the reference value. If it is determined that the mixture of the refrigerant and the refrigerating machine oil falls into a two phase separation state, the determination signal is output to the control device. For example, when the state detecting device is constructed from a sensor for sensing a transmittance of light of the mixture, the determining device determines whether the detection signal related to the detected transmittance of light corresponding to the degree of separation of the mixture is less than a predetermined reference value, and the determination signal is output to the control device if the detection signal is less than the reference value. The control device controls the displacement of the compressor device to a smaller displacement in accordance with the determination signal output from the determining device. As the result of the reduction of the displacement of the compressor device, the amount of the mixture circulated in the circulating circuit decreases, and the temperature of the circulated mixture is lowered. The circulated mixture can get out from two phase separation area caused depending upon the temperature of the mixture. The temperature of the mixture is controlled at a sufficiently low temperature, and the refrigerating machine oil can sufficiently dissolve in the refrigerant. An sufficient amount of the refrigerating machine oil is circulated and returned to the compressor together with the refrigerant, and a lock up or a breakage of the compressor can be prevented.

Preferred embodiments of the invention will now be described with reference to the accompanying drawings, which are given by way of example only, and are not intended to limit the present invention.

DETAILED DESCRIPTION OF THE PREFERRED EMBODIMENTS OF THE INVENTION

Figure 1:
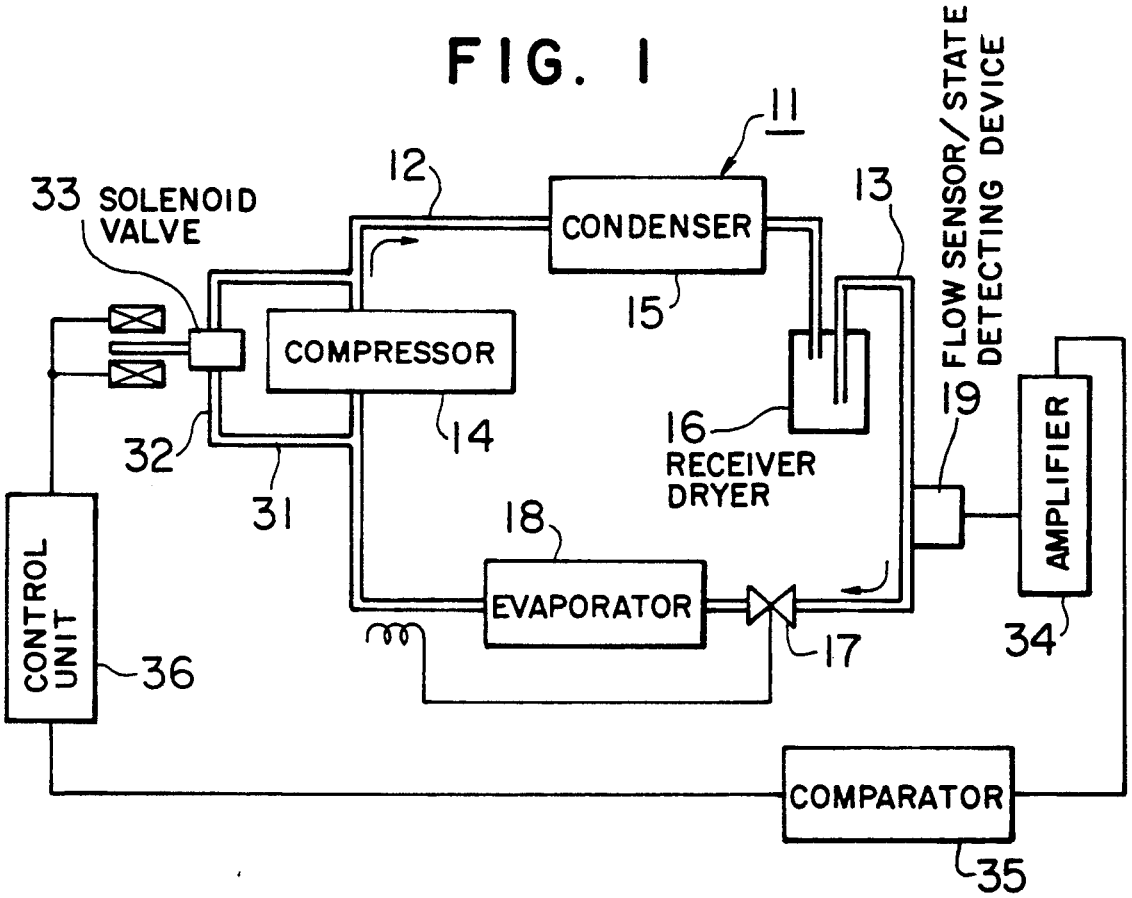
FIG. 1 is a schematic view of a refrigerator according to a first embodiment of the present invention.
Figure 2:
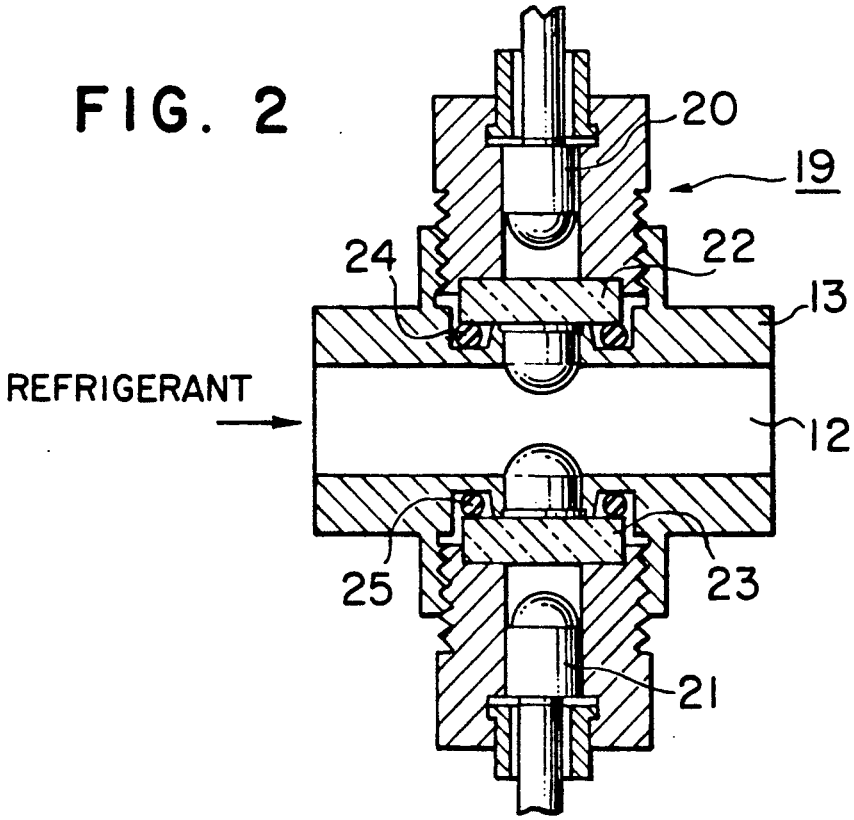
FIG. 2 is an enlarged sectional view of a photoelectric refrigerant state detecting device of the refrigerator shown in FIG. 1.

Referring to the drawings, FIGS. 1 and 2 illustrate a refrigerator according to a first embodiment of the present invention. In FIG. 1, refrigerator 11 has refrigerant circulating circuit 12 formed from pipe 13. Compressor 14, condenser 15, receiver dryer 16, expansion valve 17 and evaporator 18 are provided in circulating circuit 11 sequentially in the direction of circulation of the refrigerant which is shown by arrows. Compressor 14 is driven by, for example, an engine of a vehicle (not shown). A mixture of a refrigerant and a refrigerating machine oil (hereinafter, referred to as "refrigerant mixture") is circulated in circulating circuit 11.

FIG. 2 illustrates a flow sensor 19 provided on pipe 13 as a refrigerant state detecting device. Flow sensor 19 comprises a photoelectric sensor. Flow sensor 19 includes emitter 20 emitting a light towards the interior of pipe 13 constructed from, for example, a photodiode, and receiver 21 for receiving the light transmitted through the pipe (and refrigerant mixture in the pipe) constructed from, for example, a phototransistor. Sensor 19 is attached to pipe 13 so that emitter 20 and receiver 21 are aligned with each other. O-rings 24 and 25 are interposed between sensor 19 and pipe 13 for sealing therebetween. The light emitted from emitter 20 is sent through sight glass 22 into the interior of pipe 13. The light transmitted through the pipe is received by receiver 21 through sight glass 23. Flow sensor 19 detects transmittance of the light transmitted by emitter 20 and received by receiver 21. The transmittance of the light transmitted through pipe 13 indicates a degree of separation of refrigerant mixture. If the refrigerating machine oil is sufficiently mixed with and dissolved in the refrigerant, the amount of light transmitted through the refrigerant mixture is relatively large. If the refrigerating machine oil is insufficiently mixed with and not dissolved in the refrigerant, i.e., the refrigerating machine oil and the refrigerant are in two phase separation state, the refrigerant mixture becomes translucent and the amount of light transmitted through the mixture refrigerant is relatively small. Therefore, flow sensor 19 can detect a degree of separation of the refrigerant mixture circulating in a high-pressure side of circulating circuit 12.

In FIG. 1, a bypass circuit 31 is provided on circulating circuit 12 in this embodiment. Bypass circuit 31 comprises pipe 32 coupled to an input and an output of compressor 14 and solenoid valve 33 provided on the pipe. Solenoid valve 33 controls the amount of refrigerant mixture passing through bypass circuit 31 by control of on-off ratio thereof.

Flow sensor 19 is coupled to amplifier 34 for amplifying a signal sent from the flow sensor. Amplifier 34 is coupled to comparator 35 provided as a device for comparing a signal sent from the amplifier with a predetermined reference value, determining whether the signal is greater or less than the reference value and outputting a determination signal to control unit 36. Control unit 36 is coupled to comparator 35 and solenoid valve 33. Control unit 36 outputs a signal to solenoid valve 33 for controlling the operation of the solenoid valve in accordance with the signal sent from comparator 35.

In the refrigerator, a phase of the refrigerant mixture is detected by flow sensor 19. After the detection signal is amplified by amplifier 34, the detection signal is compared with the reference value in comparator 35. The reference value is preset as a boundary value between a two phase separation area of the refrigerant mixture in which a part of the refrigerating machine oil is separated from the refrigerant and a normal area in which the refrigerating machine oil is uniformly mixed and dissolved in the refrigerant. If the detection signal is less than the reference value, then the refrigerant mixture is in a two phase separation state, and comparator 35 outputs a determination signal indicating two phase separation to control unit 36. Control unit 36 outputs a signal for operation of solenoid valve 33 in accordance with the determination signal sent from comparator 35. Solenoid valve 33 is operated to be opened by the signal of control unit 36. The refrigerant mixture flows through bypass circuit 31 as well as through compressor 14. Consequently, the displacement of compressor 14 decreases by the flow through bypass circuit 31. The amount of the refrigerant mixture circulated in a high-pressure side of circulating circuit 12 decreases, and the temperature of the circulated refrigerant mixture is lowered accordingly.

In the operation of solenoid valve 33, the on-off ratio of the solenoid valve may be controlled. Namely, the on-off ratio is increased when the determination signal indicating two phase separation is output from comparator 35.

Figure 3:
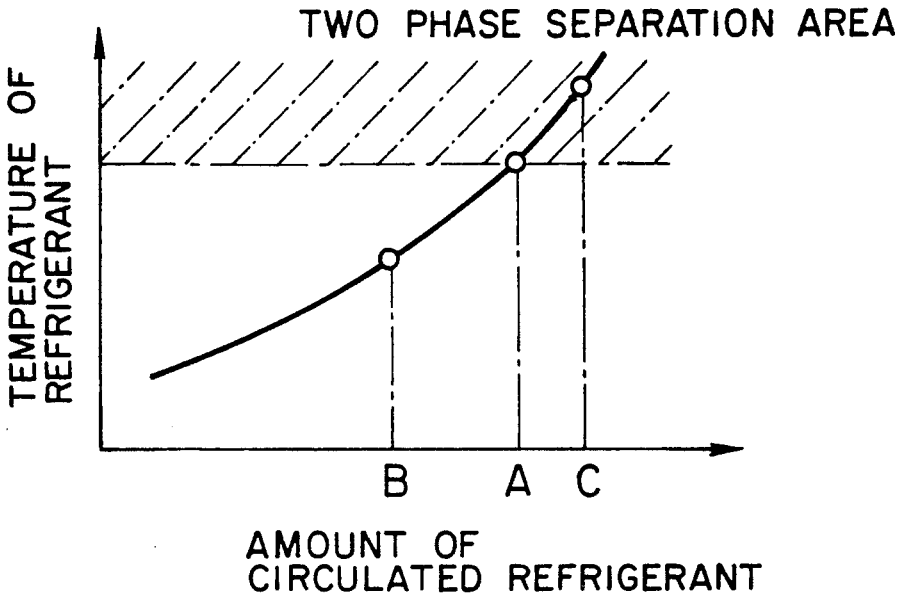
FIG. 3 is a graph showing the relationship between amount of circulated refrigerant and temperature of the refrigerant in a high-pressure side of a circulating circuit.

FIG. 3 illustrates a relationship between amount of circulated refrigerant mixture and temperature of the refrigerant mixture in a high-pressure side of circulating circuit 12. As the amount of circulated refrigerant mixture increases, the temperature of the refrigerant mixture increases. Point "B" is in a normal area, point "C" is in a two phase separation area and point "A" is on a boundary between the normal area and the two phase separation area. If the temperature of the refrigerant mixture enters into the two phase separation area such as point "C", the refrigerant mixture becomes translucent. The degree of separation of the refrigerant mixture is detected by flow sensor 19, the detection signal is output to comparator 35, and the determination signal of two phase separation is output to control unit 36. Solenoid valve 33 is operated to open bypass circuit 31 or increase the amount of refrigerant mixture passing through the bypass circuit by the operation signal output from control unit 36. Since the amount of the refrigerant mixture circulated by compressor 14 decreases by the bypass flow, the temperature of the circulated refrigerant mixture lowers below the boundary such as point "B". As a result, the phase of the refrigerant mixture changes from the two phase separation area to the normal area, and a lock up or a breakage of compressor 14 can be prevented.

Figure 4:
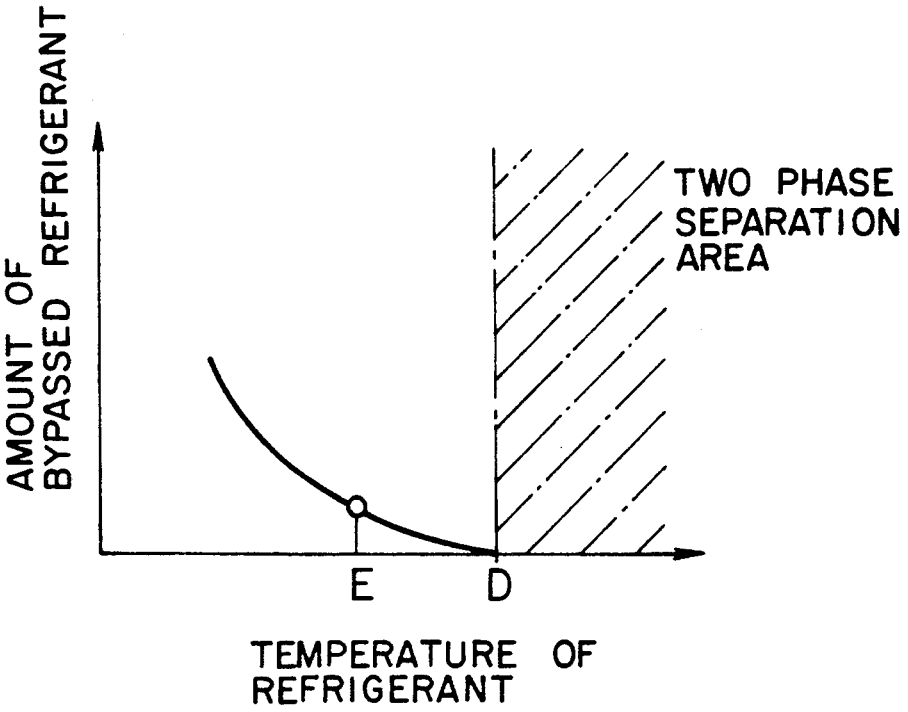
FIG. 4 is a graph showing the relationship between temperature of circulated refrigerant and amount of bypassed refrigerant in the refrigerator shown in FIG. 1.

FIG. 4 illustrates the relationship between the temperature of the refrigerant mixture circulated in circulating circuit 12 and the amount of the bypassed refrigerant mixture through bypass circuit 31. When the temperature of the refrigerant mixture has reached the boundary of the two phase separation area (point "D"), a part of the refrigerant mixture is bypassed through bypass circuit 31. As the amount of the bypassed refrigerant mixture increases, the temperature of the refrigerant mixture is lowered. Therefore, the temperature of the refrigerant mixture is controlled to stay at a desirable temperature, for example, point "E" by an appropriate control of solenoid valve 33.

Although it can be determined when the refrigerant mixture enters into a two phase separation area by using a temperature sensor for sensing the temperature of the circulated refrigerant mixture, in practice it is difficult to determine because the characteristic curve indicating the relationship between amount of circulated refrigerant mixture and temperature of the refrigerant mixture, such as a curve shown in FIG. 3, varies depending upon an atmosphere temperature. In the present invention, the degree of separation of the refrigerant mixture can be properly and accurately detected by photoelectric sensor 19.

Figure 5:
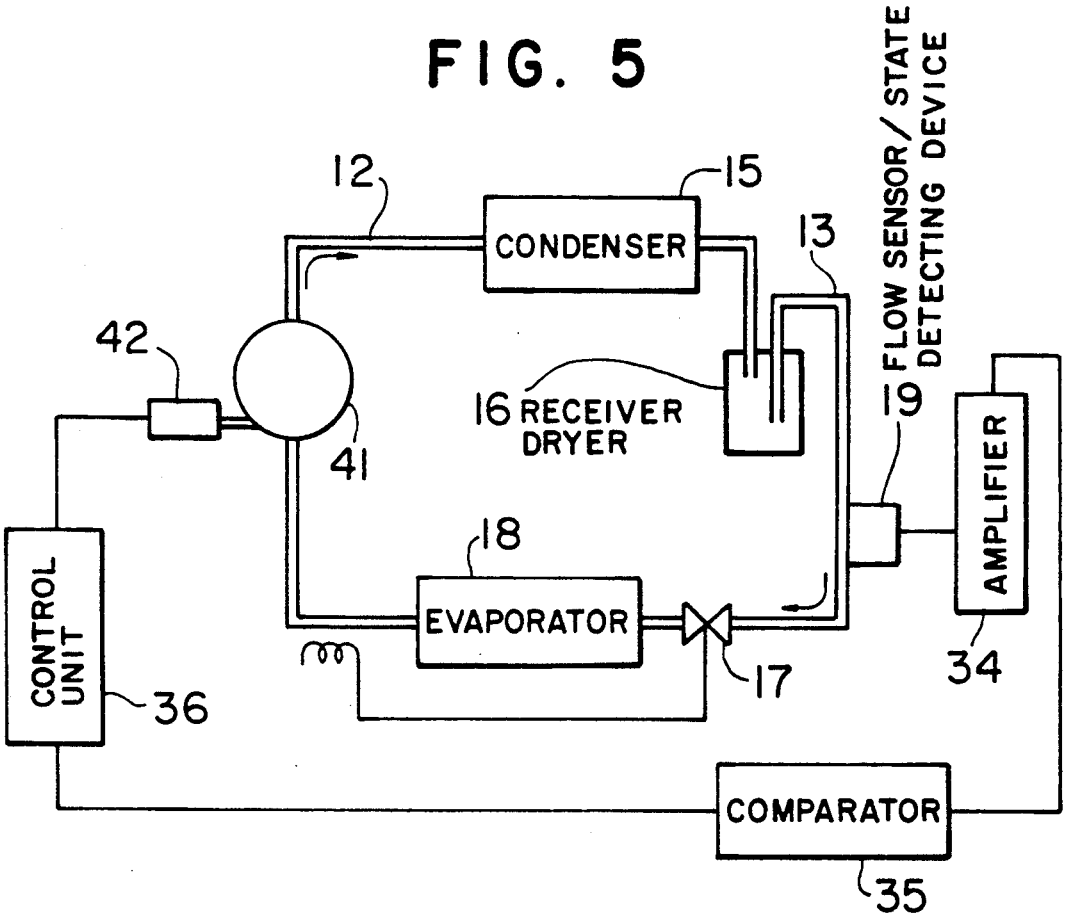
FIG. 5 is a schematic view of a refrigerator according to a second embodiment of the present invention.
Figure 6:
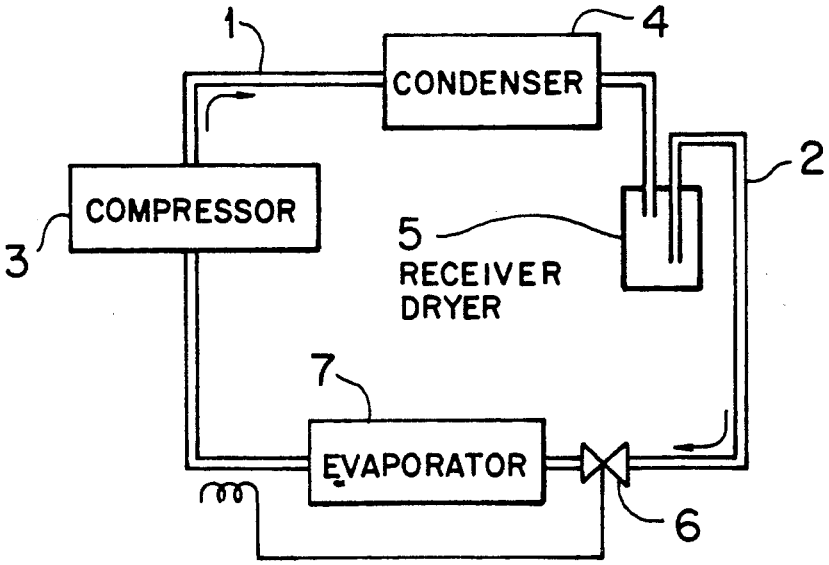
FIG. 6 PRIOR ART
FIG. 6 is a schematic view of a prior art refrigerator.

FIG. 5 illustrates a refrigerator according to a second embodiment of the present invention. In this embodiment, a variable displacement compressor 41 is used and a bypass circuit is not necessary. An actuator 42 is attached to compressor 41 for controlling the displacement of the compressor. The operation of actuator 42 is controlled in accordance with a signal sent from control unit 36. Other parts of the refrigerator are substantially the same as in the first embodiment shown in FIGS. 1 and 2. In such a structure, the displacement of compressor 41 is appropriately decreased when flow sensor 19 detects that the refrigerant mixture enters into a two phase separation area. The temperature of the refrigerant mixture is lowered by the reduction of the displacement, and the two phase separation state can be dissolved.

Although flow sensor 19 is disposed on pipe 13 at a position between receiver dryer 16 and expansion valve 17, the flow sensor may be disposed in or on the receiver dryer.

Although several preferred embodiments of the present invention have been described herein in detail, it will be appreciated by those skilled in the art that various other embodiments, as well as modifications and alterations to the described embodiments may be made without materially departing from the novel teachings and advantages of this invention. Accordingly, it is to be understood that all such other embodiments, modifications and alterations are included within the scope of the invention as defined by the following claims.

What is claimed is:

1. A refrigerant circulating circuit for circulating a mixture of a refrigerant and a refrigerating machine oil, the circulating circuit comprising:

compressor means for compressing said mixture at variable displacement;

a condenser coupled to an output of said compressor means;

an expansion valve coupled to an output of said condenser;

an evaporator coupled to an output of said condenser and to an input of said compressor means;

state detecting means, coupled between said condenser and said expansion valve, for detecting a degree of separation of said mixture in the circulating circuit and outputting a detection signal related to the detected degree of separation;

determining means, coupled to said state detecting means, for determining whether said detection signal is greater or less than a reference value and outputting a determination signal related to the determination; and control means, coupled between said determining means and said compressor means, for controlling the variable displacement of said compressor means in accordance with the determination of said determining means.

2. The refrigerant circulating circuit according to claim 1, wherein said state detecting means comprises a sensor for sensing a transmittance of light of the mixture, and said control means controls the variable displacement of said compressor means to decrease when said detection signal is less than said reference value.

3. The refrigerant circulating circuit according to claim 2, wherein said sensor comprises an emitter for emitting light and a receiver for receiving light transmitted through the mixture.

4. The refrigerant circulating circuit according to claim 1, wherein said compressor means comprises a variable displacement compressor.

5. The refrigerant circulating circuit according to claim 4, wherein said control means includes an actuator provided for controlling a displacement of said variable displacement compressor.

6. The refrigerant circulating circuit according to claim 1 further comprising a receiver dryer provided between said condenser and said expansion valve.

7. The refrigerant circulating circuit according to claim 6, wherein said state detecting means is disposed between said receiver dryer and said expansion valve.

8. The refrigerant circulating circuit according to claim 6, wherein said state detecting means is disposed on said receiver dryer.

9. The refrigerant circulating circuit according to claim 1, wherein said determining means includes a comparator for comparing said detection signal with said reference value.

10. A refrigerant circulating circuit for circulating a mixture of a refrigerant and a refrigerating machine oil, the circulating circuit comprising:

compressor means for compressing said mixture;

a condenser coupled to an output of said compressor means;

an expansion valve coupled to an output of said condenser;

an evaporator coupled to an output of said condenser and to an input of said compressor means;

state detecting means, coupled between said condenser and said expansion valve, for detecting a degree of separation of said mixture in the circulating circuit and outputting a detection signal related to the detected degree of separation;

determining means, coupled to said state detecting means, for determining whether said detection signal is greater or less than a reference value and outputting a determination signal related to the determination; and control means, coupled between said determining means and said compressor means, for controlling the displacement of said compressor means in accordance with the determination of said determining means.

11. The refrigerant circulating circuit according to claim 10, wherein said state detecting means comprises a sensor for sensing a transmittance of light of the mixture, and said control means controls the displacement of said compressor means to decrease when said detection signal is less than said reference value.

12. The refrigerant circulating circuit according to claim 11, wherein said sensor comprises an emitter for emitting light and a receiver for receiving light transmitted through the mixture.

13. The refrigerant circulating circuit according to claim 10, wherein said compressor means comprises a compressor, a bypass circuit coupled between an input and an output of said compressor for bypassing an amount of said mixture in said circulating circuit and means for controlling the amount of the bypassed mixture in accordance with the determination of said determining means.

14. The refrigerant circulating circuit according to claim 13, wherein said bypass amount control means comprises a solenoid valve.

15. The refrigerant circulating circuit according to claim 10 further comprising a receiver dryer provided between said condenser and said expansion valve.

16. The refrigerant circulating circuit according to claim 15, wherein said state detecting means is disposed between said receiver dryer and said expansion valve.

17. The refrigerant circulating circuit according to claim 15, wherein said state detecting means is disposed on said receiver dryer.

18. The refrigerant circulating circuit according to claim 10, wherein said determining means includes a comparator for comparing said detection signal with said reference value.

* * * * *